United States Patent [19]

Huang et al.

[11] Patent Number: 4,505,205

[45] Date of Patent: Mar. 19, 1985

[54] ENCLOSED FLOOR TRACK SYSTEM

[75] Inventors: Min N. Huang, Madison; David L. Brethorst, Lodi, both of Wis.

[73] Assignee: DEC International, Inc., Lodi, Wis.

[21] Appl. No.: 431,250

[22] Filed: Sep. 30, 1982

[51] Int. Cl.[3] ..... B61B 13/00

[52] U.S. Cl. ..... 104/139; 99/535; 104/146

[58] Field of Search ..... 104/139, 140, 146; 17/15, 24; 99/467, 517, 535; 134/104, 123, 154, 182, 183; 118/634, 635; 198/861

[56] References Cited

U.S. PATENT DOCUMENTS

| | | | |
|---|---|---|---|
| 386,184 | 7/1888 | Chesebrough | 104/140 |
| 388,072 | 8/1888 | Phillips | 104/140 |
| 2,700,937 | 2/1955 | Bock | 104/140 |
| 2,945,605 | 7/1960 | Menough | 198/861 X |
| 3,563,203 | 2/1971 | Stiltner | 198/861 X |
| 3,809,011 | 5/1974 | Fabre et al. | 118/635 |
| 3,859,925 | 1/1975 | Hartz | 104/139 X |
| 3,937,180 | 2/1976 | Wiggins | 118/635 |
| 4,067,257 | 7/1978 | Pentith | 104/140 |

*Primary Examiner*—Randolph Reese

*Attorney, Agent, or Firm*—Lee, Smith & Zickert

[57] ABSTRACT

An enclosed floor track system for use with wheeled hand trucks or the like in sanitary liquid treatment chambers. An elongate wheel channel into which the wheels of the truck are disposed includes a cover comprising either a cover plate or inflatable elastomer seals to prevent liquid from entering the contaminated wheel channel. In the cover plate embodiment the wheel channel includes an elongate side slot to accommodate the wheel axle structure. The inflatable seal is split to slidably receive a wheel axle structure.

12 Claims, 4 Drawing Figures

ENCLOSED FLOOR TRACK SYSTEM

BACKGROUND OF THE INVENTION

The present invention relates generally to track transport systems, and more particularly to floor track systems such as used in sanitary fluid treatment chambers for transporting thereinto food stuffs on wheeled hand trucks, or the like.

In processing cooked meat products, such as smoked meat and sausage, it is a conventional practice to roll racks or hand trucks loaded with cooked meat into a cooling chamber and circulate therethrough chilled air to cool the meat. This method of chilling the cooked meat has the major drawback of evaporating meat juices and thus causing excessive dehydration and shrinkage of the product. This dehydration, especially in meat products such as sausage or frankfurters results in difficulty in removing the cellulose casing. Another disadvantage of air chilling is that the rate of heat transfer from the meat to the air is relatively slow.

More recent approaches to chilling cooked meat products employ fluid treatment chambers with a system for showering the meat products with a chilled brine solution to quickly transfer the heat from the meat to the solution where it can be recovered, recooled and then recirculated. Because of the volume of water needed as part of the brine solution to cool the meat products is significant, it becomes economically advantageous to recover the brine solution from the chamber and recirculate it.

The meat products processed in this manner are generally for human consumption and must therefore be processed in a sanitary environment as required by the U.S. Department of Agriculture. It is also desirable to chill large quantities of meat products at one time, and be able to quickly move such large quantities about the processing plant as desired. The method of transporting cooked meat into and out of the fluid treatment chamber must maintain the sanitary condition of the chamber as well as the recovered brine solution.

One transport system used with a certain degree of success in cooling chambers is the overhead rail or trolley onto which product carriers, such as racks or trees, are suspended and automatically moved or manually pushed and pulled by a gaff or similar device. These overhead rail transport systems suffer the disadvantage of fixing the route of transfer. In other words, the meat products can only be moved to places where an overhead rail or trolley has been previously installed. Another disadvantage of the overhead trolley system, when used in recirculating brine solution environments, is that the solution which comes into contact with the lubricating grease on the transport wheels becomes contaminated, and cannot thereafter be used unless sterilized. This disadvantage has been overcome by locating the brine shower system below the overhead track system, and by employing a false ceiling between the shower system and the track system with slots in the ceiling through which the depending arm of the meat carriers move when transported. This slot can be covered with rubber flaps which seal the slot, but yet allow movement of the depending arm.

These and other disadvantages of the overhead rail system have, by and large, been overcome by the use of wheeled dolly-like floor trucks which can be pushed to any desired destination, or stored at remote seldom-used locations. The mobility advantage gained by the wheeled floor trucks is, however, offset by the unsanitary nature of the wheels which invariably become contaminated with foreign substances picked up from the processing plant floor.

The use of wheeled hand trucks to carry meat products into a sanitary chilling chamber has therefore presented an impediment to the recovery and reuse of the cooling brine solution. This problem can be circumvented by retreating to the air chilled chamber, but only at the expense of product dehydration and longer cooling cycles. It would therefore be advantageous to provide a chilling system which uses fluid as a quick cooling agent, along with wheeled hand trucks for quick and versatile meat products transportation, and also where the contamination attendant with the use of wheels is eliminated as a factor so that the cooling fluid maintains its sanitary nature and thus can be reused without incurring the expense of reprocessing it to a sanitary condition.

The primary object of the invention therefore is to provide a floor transport system which allows dolly-like floor trucks to be used in a fluid treatment center in a manner which prevents the wheels or other support structure on the dolly from contaminating the treatment fluid.

Another objective of this invention is to provide a floor transport track system where the wheels of the trucks used to support the product to be treated can be segregated from the recirculated treatment solution such that any objectionable contaminant on the wheels will not be carried into the treatment solution and prevent the reuse thereof.

Other objects of the invention will become apparent from the following detailed description of the various embodiments when considered in connection with the attached drawings.

SUMMARY OF THE INVENTION

In accordance with the invention there is provided an enclosed floor track system for use in a fluid treatment chamber for moving wheeled trucks, or the like, into and out of the chamber without contaminating the sanitary environment of such chamber.

In one embodiment of the invention the enclosed track includes a wheel channel into which the wheels of the truck roll, and which is disposed above the fluid level on the floor by support legs. The wheel channel includes opposed sidewalls one of which extends upwardly more than the other and which has attached to it a cover plate horizontally overlying the top of the channel. The vertical space between the shorter sidewall and the cover plate above it accommodates the axle structure connecting the truck frame to the wheel disposed in the channel. In this manner, the wheel channel standing off the floor, and the overlying plate prevent showered fluid, or fluid flowing on the floor, from entering the wheel channel area and becoming contaminated by the truck wheels.

The overlying cover plate may be connected to the longer sidewall by a hinge so that it can be pivoted away from the wheel channel and thereby facilitate the cleaning of the channel.

In another embodiment of the invention the enclosed floor track is structured to accommodate trucks with downwardly depending struts supporting the wheel structure. Here, the sidewalls of the wheel channel extend upwardly beyond the top of the wheel structure and include at the top edges thereof inflatable elastomer seals. These seals are hose-like and are attached along the length of the sidewall top edges so as to enclose around the hand truck wheel struts and prevent entry of the brine solution into the guide track. When inflated, the elastomer strips perfect a seal around the wheel struts, as well as against itself along the remaining length of the floor track.

DETAILED DESCRIPTION OF THE INVENTION

Figure 1:
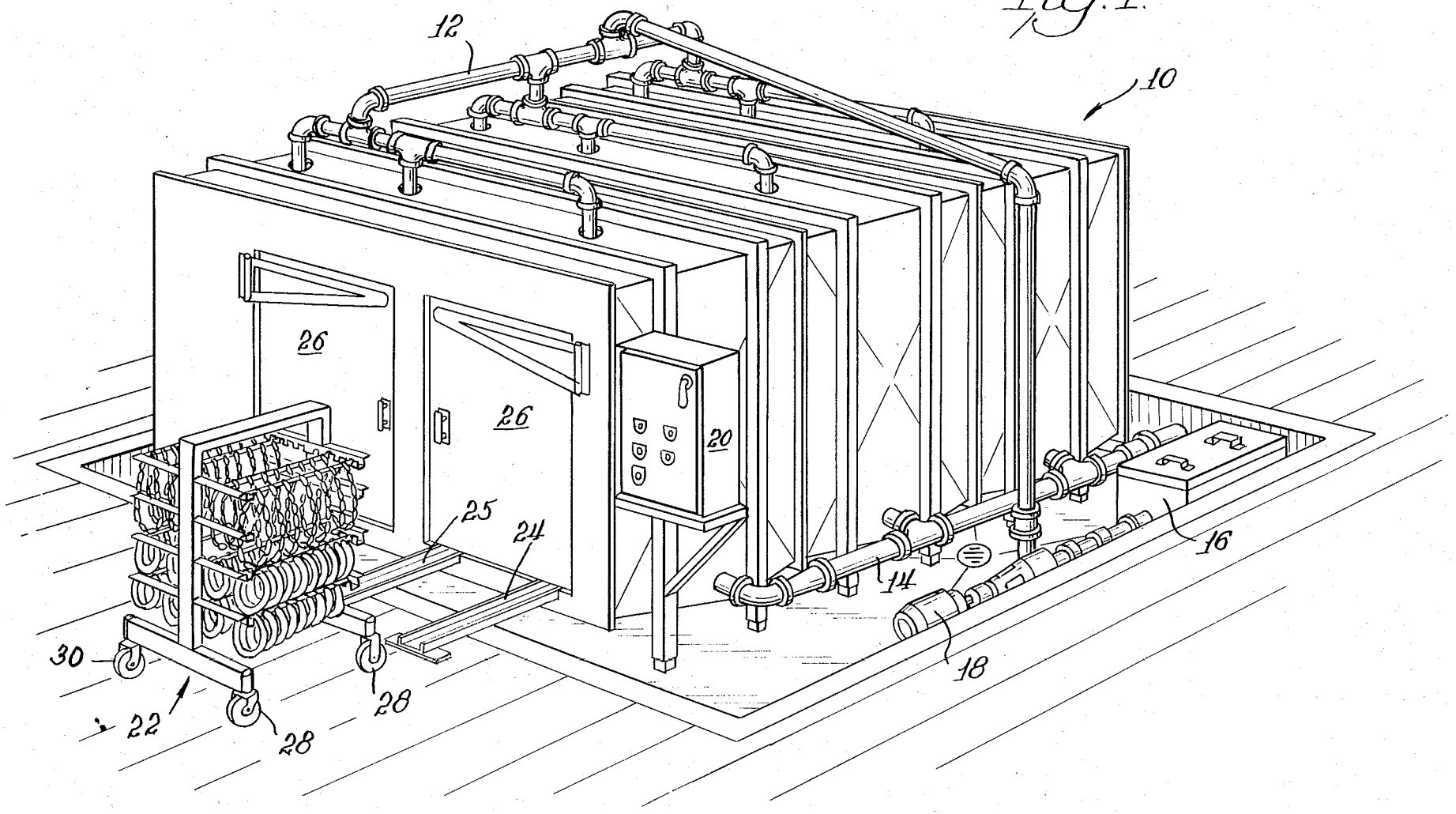
FIG. 1 is an isometric view of a fluid treatment chamber with which the present invention is well adapted for use.

Referring generally to the drawings, the fluid treatment chamber utilizing the features and advantages of the present invention is generally identified by the reference character 10. While it should be realized that the present invention will be described in terms of use with a meat product chilling chamber, it should be understood that the principles of the invention are not limited thereto and thus may find applications in other industries. For example, wheeled hand trucks are only exemplary of the transport vehicles which may be used with the present invention. Other types of vehicles may, of course, be advantageously used.

Referring particularly to FIG. 1, the environment in which the present invention is commercially embodied includes a meat product chilling chamber 10, a brine distribution piping system 12, a return piping system 14, a brine receptor 16 and a brine recirculation pump 18. A control panel 20 is utilized to start and stop the brine circulation system, and also control the rate of flow of the brine solution.

The brine solution is pumped under pressure through the distribution piping system 12 where it is showered (not shown) onto meat-laden hand trucks, such as shown generally by reference character 22. The temperature of the cooked meat is quickly lowered by transferring the heat to the showered liquid which then drains off the meat and onto the tracks and floor below. The floor of this fluid treatment chamber is inclined to collect the warm brine solution in a sump (not shown) where it is then cooled by a refrigeration system (not shown) and returned to be cycled again. Because the liquid treatment chamber 10 and the associated circulation equipment does not form a part of the present invention, this disclosure will not be further encumbered by a detailed analysis of such apparatus.

The present invention relates to an enclosed floor track system for transporting the hand trucks 22 into and out of the fluid treatment chamber 10. Chamber doors 26 keep the showered brine solution contained within the chamber when closed, and when open permit the transportation of meat-laden hand carts 22 into and out of such chamber 10 via the floor tracks 24.

As discussed above, the present invention is well adapted for use in this environment by preventing the brine solution from being showered onto the wheel structure 28 of the hand trucks and becoming contaminated. FIG. 1 shows an open floor track 24 for the set of wheels 28 on one side of the hand truck, and another open track 25 for the other set of wheels 30. These tracks 24 and 25 extend to the entrance of fluid treatment chamber 10. Suitable ramps (not shown) can be provided to guide the wheels 28 of the truck 22 onto the floor tracks 24, 25. The floor tracks inside the cooling chamber are slightly pitched to drain any liquid within the tracks into a waste sewer (not shown). The majority of liquid which may enter the track system is water which is used to flush and thus clean the track system. Any brine solution which may leak into the track system becomes contaminated by the hand truck wheels 28 and 30, and is also drained to the waste sewer.

Figure 2:
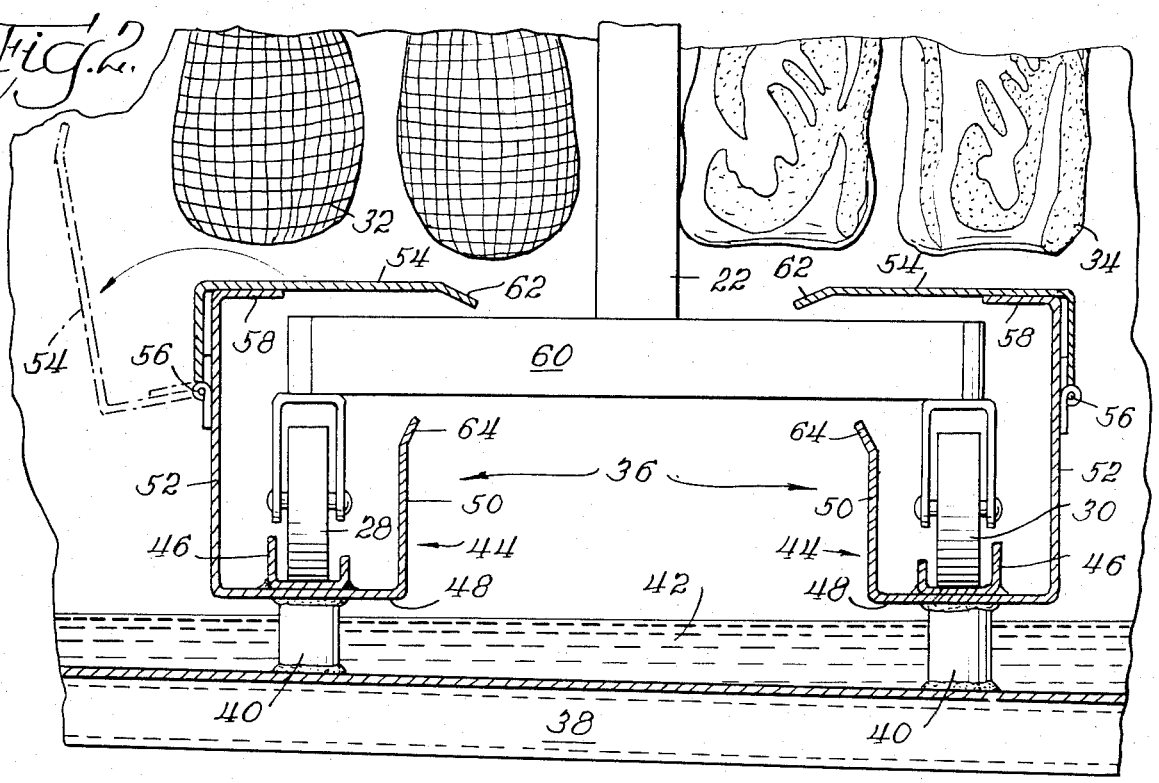
FIG. 2 is a cross-sectional view of one embodiment of the enclosed floor track system adapted for use with a horizontally axled hand truck.
Figure 4:
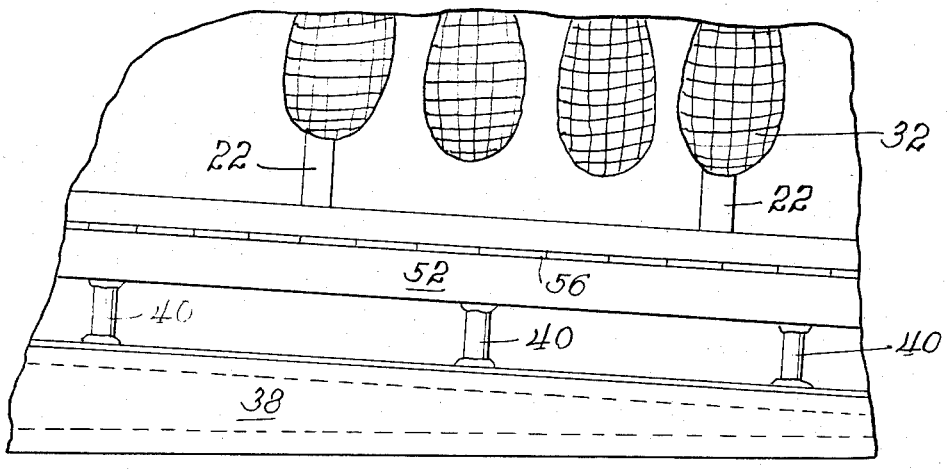
FIG. 4, is a partial side view of FIG. 2, showing the floor track system pitched to drain away liquid.

Turning now to FIG. 2 there is shown a cross-section of the enclosed floor track system as utilized within the fluid treatment chamber 10. It can be seen that some of the meat products 32 and 34 are suspended on the hand truck 22 directly over the tracks 36 where brine solution dripping off the meat products would be contaminated by the hand truck wheels 28 and 32 were it not for the enclosed floor tracks of the present invention. The enclosed tracks, generally indicated by reference character 36, as utilized within the fluid treatment chamber are supported above the chamber floor 38 by support legs 40. As noted by FIGS. 1 and 4, the sloping grade of the floor upon which the track system rests provides the floor tracks 36 with an incline sufficient to drain washing fluids into the waste sewer. The length of the support legs 40 may also be varied to achieve different angles of incline. The overall structure of the hand truck, except the wheels, and the chamber interior including the floor are sanitary. Thus, any brine solution coming into contact with the hand truck structure or chamber floor 38 is also maintained sanitary and can be reclaimed and recirculated. The enclosed floor track system shown in FIG. 2 prevents showered or dripping brine from entering into the track system, and what little solution which may enter the tracks and become contaminated is drained away separately from the solution 42 on the chamber floor 38.

The enclosed floor tracks shown in FIG. 2 are well adapted for use with hand trucks having horizontally axled wheel structures. The tracks 36 of this embodiment include an open wheel channel 44 into which the wheels 28 or 30 of the hand truck are moved in the chamber. Running along the length of the channel 44 and centrally located therein is a wheel guide 46 which keeps the hand truck centered within the bottom of the track system. The wheel guides 46 are welded to the wheel channels 44 which, in turn, are welded to the support legs 40. Each wheel channel 44 includes a bottom portion 48 and upwardly extending sidewalls 50 and 52. The outer sidewall 52 extends upwardly a distance greater than that of the inner sidewall 50.

A cover plate 54 generally overlies the top of the wheel channel 44 and is attached to the outer sidewall 52 by a hinge 56. This hinged connection permits the cover plate 54 to be pivoted away from the wheel channel 44 to facilitate cleaning it by flooding or otherwise. The outer sidewall 52 is angled inwardly at its top end 58 to serve as a rest stop for the cover plate 54 when it is swung to a position enclosing the floor track system. The vertical space between the upper edge of the inner sidewall 50 and the overlying cover plate 54 accommodates the horizontal axle structure 60 of the hand truck 22. The end of the cover plate 54 and the wheel channel inner sidewall 50 include end portions 62 and 64 respectively, bent to prevent splashing, spattering or running of the brine solution into the floor track system. Also, the cover plate 54 extends laterally beyond the inner sidewall 50 to form a drip edge and assure that no liquid falls or drips into the wheel channel area.

It is thus seen that the enclosed floor track system shown in FIG. 2 greatly enhances the recovery and reuse of the brine solution by segregating the hand truck wheel structure from the general environment within the fluid treatment chamber 10. Needless to say, the recovery and reuse of the brine solution preserves natural resources as well as achieves an economic advantage.

Figure 3:
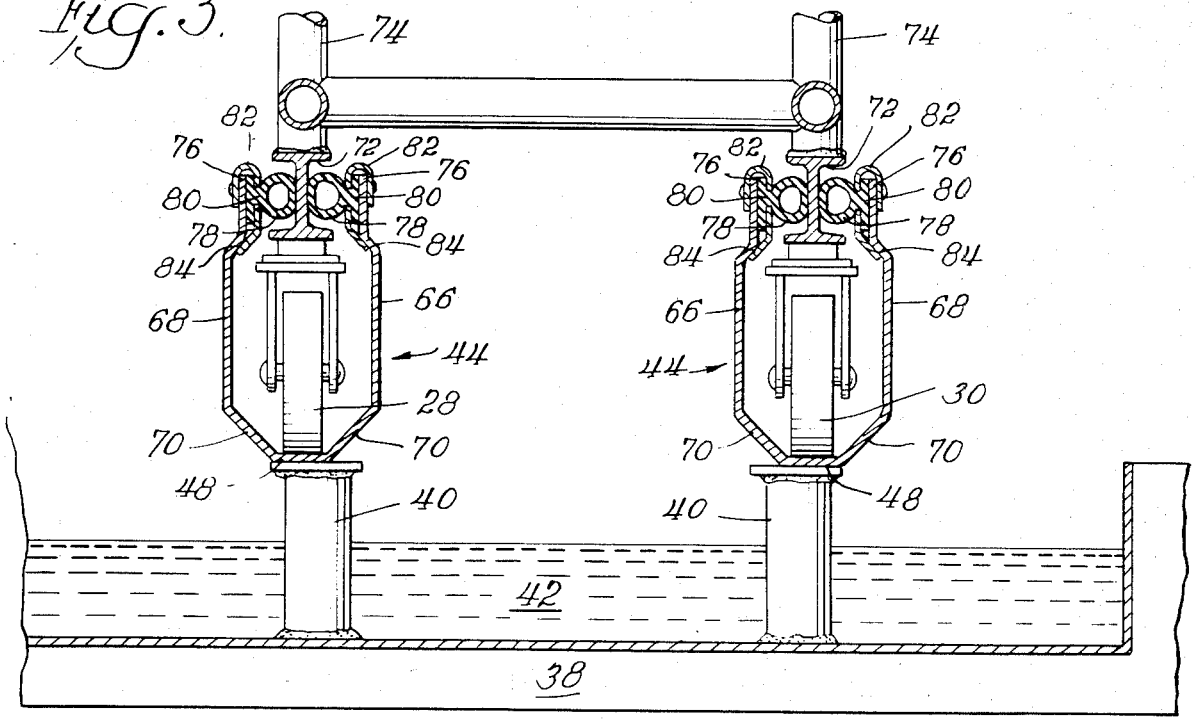
FIG. 3 is a cross-sectional view of another embodiment of the floor track system utilizing inflatable seals to enclose the interior wheel channel of the track.

With reference now to FIG. 3 there is shown another embodiment of the enclosed floor track system according to the present invention. This embodiment also includes a wheel channel 44 for generally enclosing the wheel structure of a hand truck and thereby segregating such wheel structure from the environment of the fluid treatment chamber 10. The wheel chamber 44 includes a bottom portion 48 and also upwardly extending identically-structured sidewalls 66 and 68. The wheel channel 44 is somewhat wider than the width of a hand truck wheel at its bottom 48, and then angles upwardly a short distance, and then again vertically to form the sidewalls. The narrow track bottom 48, along with angled parts 70 form a wheel guide which maintains the hand truck wheels generally centered on the bottom of the track channel. The tendency of the wheels of a hand truck is to roll along the channel bottom 48 rather than climb the angled part 70 of the sidewalls.

The illustrated hand truck of FIG. 3 is of the type having a depending I-beam strut connecting the wheel section to the hand truck frame 74. The sidewalls 66 and 68 extend upwardly a distance such that the longitudinal edges thereof are proximate the center of the I-beam 72. The sidewall upper edges 76 have attached to the inner surfaces thereof inflatable elastomer-type seals 78. These seals are of the Nytryle type of material and are shown in FIG. 3 in the inflated state fitting snugly around the central part of the I-beam 72. These inflatable elastomer seals are commercially available and thus need not be discussed here in further detail. In the inflated state the seal 78 on each side of the I-beam section 72 makes firm contact with the I-beam and thereby prevents the brine solution from entering the guide track channel. At locations along the length of the guide track where there is no hand truck and thus no I-beam strut, the inflatable seals 78 will expand to seal against each other. When inflated, the seals 78 being closed tightly around the I-beam strut 72 also act as a brake on the meat-laden hand trucks so as to prevent movement of the trucks along the slightly inclined track system.

When it is desired to remove the hand truck 22 from the fluid treatment chamber 10 the compressed air within the seal 78 is released whereupon the seals are deflated leaving sufficient space between them for ease of movement of the I-beam 72 and thus the hand truck.

Each inflatable seal has a flat base section 80 compressed to its associated channel sidewall by two clamps 82 and 84. Clamp 84 may be fixed to the floor track sidewall by spot welding, and the top clamp 82 may be removably attached to the sidewall by suitable means, such as by a screw. The inflatable seal member brackets 82 and 84, as well as the enclosed wheel channels 44, are preferably constructed of stainless steel to resist corrosive attack by the brine solution.

It is readily seen that a need exists for the use of an enclosed floor track system, and that the present invention fulfills such need. In addition to preventing corrosion of the hand truck wheel bearings, and the deterioration of the rubber wheels, the enclosed track system according to the present invention prevents the brine solution from coming into contact with the hand truck wheels and becoming contaminated. Recirculation and reuse of the brine solution may thereby be effected without the need for decontaminating the brine solution.

Although the invention has been described above with a certain degree of particularity with respect to the apparatus involved, it should be understood that this disclosure has been made only by way of example. Consequently, numerous changes in the details and construction of the enclosed floor track system may be apparent to those familiar with the art and may be resorted to without departing from the scope of the invention as claimed.

What we claim is:

1. A protective enclosed track for movement therein of the support structure associated with a truck or the like, comprising an elongate leak proof enclosure including two opposing sides rigidly integral with a load bearing bottom surface onto which the support structure of said truck is movably engaged, a single top cover movable to allow access to the inside of said enclosure, and a longitudinal side slot in said enclosure for accommodating the support structure of said truck.

2. The enclosed track of claim 1 for use in liquid treatment environments, wherein said track further includes means for longitudinally inclining said track to drain any liquid within said track away therefrom.

3. An accessible enclosed track with a side entrance and for use in a liquid treatment chamber with a truck or the like having wheels horizontally axled, comprising:

and elongate channel with a longitudinal side slot defining said side entrance into which one or more wheels of said truck are disposed, said channel being enclosed along the bottom and first and second sides thereof so as to prevent liquid on said floor from flowing thereinto;

a hinge; and a single cover having a horizontal portion overlying the top of said channel and spaced vertically from said first side of said channel to provide said side entrance, and a vertical portion the bottom edge of which is hingeably attached to said second side of said channel at a location spaced downwardly a distance from the top of said second side.

4. The enclosed track of claim 3 further including wheel guide means disposed on the bottom of said channel for guiding the wheels of said truck centrally along the bottom of said channel.

5. The enclosed track system of claim 3 further including means for limiting the rotational movement of said cover to about 180 degrees, whereby the horizontal portion of said cover remains horizontal whether open or closed.

6. A floor track system for use in transporting wheeled dolly-type food trucks into and out of a sanitary liquid treatment chamber, a track of said system comprising:

an elongate protective channel into which one or more of the wheels of said truck are guidably moved, said channel including a bottom and opposed first and second sidewalls, the first sidewall extending vertically a distance more than that of the second sidewall;

a single cover hingeably attached to said channel to allow access thereto when opened, and disposed so as to overlie the top of said channel when closed to thereby prevent airborne liquid from entering said channel, said cover extends over the top of said channel and laterally beyond said second sidewall whereby the vertical space between said first sidewall and said overlying cover accommodates an axle structure connecting the wheel to said truck;

a load bearing wheel track fixed to the bottom of said protective channel and into which the wheels of said truck are guidably moved; and a plurality of support legs supporting said wheel track above a floor, and thus above fluid on said floor.

7. The track system of claim 6 wherein said cover includes a horizontal portion overlying said channel, and a vertical portion a lower edge of which is attached to said channel first sidewall by a hinge.

8. The track system of claim 7 wherein said first sidewall is sheet material and is angled inwardly at the top thereof so as to extend normal to the first sidewall and serves as a resilient rest stop upon which said cover can rest when in a position overlying the top of said channel.

9. The track system of claim 6 further including means for longitudinally inclining said track to drain out any liquid therein.

10. An enclosed track for use with a truck or the like, in a liquid treatment chamber, comprising:

an elongate channel with a longitudinal slot into which one or more support means of said truck are disposed, said channel being enclosed along the bottom and sides therefore so as to prevent liquid on said floor from flowing thereinto;

a plurality of legs for supporting said channel above said floor and thus above the flow of fluid on said floor; and protective means attached to and disposed along the length of said channel for covering said channel and preventing airborne liquid from entering into said channel.

11. A floor track system for use in transporting wheeled dolly-type food trucks into and out of a sanitary liquid treatment chamber, a track of said system comprising:

an elongate channel into which one or more of the wheels of said truck are guidably moved, said channel including a bottom and opposed inner and outer sidewalls, the outer sidewall extending vertically a distance more than that of the inner sidewall;

a cover plate attached to said outer sidewall and disposed so as to horizontally overly the top of said channel and thereby prevent airborne liquid from entering said channel, said cover plate extending over the top of said channel and beyond said inner sidewall whereby the vertical space between said inner sidewall and said overlying cover plate accommodates an axle structure connecting the wheel to said truck, and a plurality of support legs for supporting said track above a floor to thereby elevate said track above fluid flowing on said floor.

12. A floor track system for use in transporting wheeled dolly-type food trucks into and out of a sanitary liquid treatment chamber, a track of said system comprising:

an elongate channel into which one or more of the wheels of said truck are guidably moved, said channel including a bottom and opposed inner and outer sidewalls extending upwardly above the wheels of said truck;

inflatable seal means attached along the edge of each upwardly extending sidewall and disposed so as to generally overly the top of said channel and receive therebetween the axle structure of said wheel, whereby when each said seal is inflated and thereby expanded, each axle structure is enveloped thereby providing a liquid seal along the length of the track channel as well as around the axle structure; and a plurality of support legs for supporting said track above a floor to thereby elevate said track above fluid flowing on said floor.

* * * * *